United States Patent [19]

Marey

[11] Patent Number: 5,061,152

[45] Date of Patent: Oct. 29, 1991

[54] MOUNTING FOR VARIABLY SETTABLE STATOR BLADES IN A COMPRESSOR

[75] Inventor: Daniel J. Marey, Soisy S/Seine, France

[73] Assignee: Societe Nationale D'Etude Et De Construction De Moteurs D'Aviation, Paris, France

[21] Appl. No.: 492,992

[22] Filed: Mar. 13, 1990

[30] Foreign Application Priority Data

Mar. 15, 1989 [FR] France ..... 89 03375

[51] Int. Cl.[5] ..... F01D 17/00; F01D 9/00

[52] U.S. Cl. ..... 415/150; 415/155; 415/159

[58] Field of Search ..... 415/148, 150, 159, 155, 415/160, 209.2, 209.3, 209.4, 210.1; 403/378, 379

[56] References Cited

U.S. PATENT DOCUMENTS

| | | | |
|---|---|---|---|
| 3,314,654 | 4/1967 | Thenault et al. | 415/160 |
| 3,736,070 | 5/1973 | Moskowitz et al. | 415/160 |
| 4,367,968 | 1/1983 | Ishida | 403/122 |
| 4,585,390 | 4/1986 | Pirtle et al. | 415/160 |
| 4,773,821 | 9/1988 | Gonthier et al. | 415/160 |

FOREIGN PATENT DOCUMENTS

| | | |
|---|---|---|
| 2524934 | 10/1983 | France . |
| 965169 | 7/1964 | United Kingdom . |
| 2159887 | 12/1985 | United Kingdom . |

*Primary Examiner*—Edward K. Look
*Assistant Examiner*—Hoang Nguyen
*Attorney, Agent, or Firm*—Oblon, Spivak, McClelland, Maier & Neustadt

[57] ABSTRACT

Each blade of a stage of variably settable stator blades in a compressor of a gas turbine engine is supported at its outer end by a journal which is rotatably mounted in a radial bore in a parallelepipedic journal box of trapezoidal section mounted in a housing of complementary shape formed between connected upstream and downstream rings of the outer casing of the compressor. The blade is held radially in the journal box by two parallel pins arranged longitudinally through the box so as to engage in a peripheral groove extending at least partly around the journal of the blade.

4 Claims, 1 Drawing Sheet

MOUNTING FOR VARIABLY SETTABLE STATOR BLADES IN A COMPRESSOR

BACKGROUND OF THE INVENTION

1. Field of the Invention

The invention relates to compressors of gas turbine engines, and is particularly concerned with the mounting of a stage of variably settable stator blades in the compressor.

2. Discussion of the Prior Art

Adjustment of the orientation of the stator blades of various compressors stages is particularly desirable when, for example, at a given rating, the greatest possible pressure is sought for the various stages while retaining an adequate margin for surging.

Variable settable stator blades are generally rotated by links external of the stator casing and connected together by a control ring. In order for each blade to be rotatable, it is generally provided with journals at its head and root which are rotatably mounted in bushes or journal boxes.

French Patent No. 2 524 934 describes a blade having a root journal box with a bore in which the blade root journal rotates, the journal box having, if desired, a diamond-shaped face of which the parallel edges perform the function of limiting the maximum possible angular movement of the blade so that, should the control lever of one of the blades break, the blade would not feather or set itself across the flow of air through the stage, which would probably lead to surging of the entire stage.

U.S. Pat. No. 3,029,067 discloses settable blades against which a stop member can act to limit the possible rotation of a blade. However this arrangement is a fairly complex assembly and is limited to a compressor of the centrifugal type.

SUMMARY OF THE INVENTION

One object of the present invention is to simplify the mounting of variably settable stator blades in a compressor by providing a blade pivoting arrangement which effects both the positioning and the radial holding of the blade.

A further object of the invention, at least in one of its preferred embodiments, is to provide just as simply for limitation of the angular movement of the stator blades so as to limit the risks of a blade feathering or placing itself across the flow path if its control link breaks.

Yet another object of the invention is to provide for the radial holding of each blade and, possibly, also the limitation of its angular movement, in the region of the outer casing of the stator so as to simplify its implementation and assembly.

According to the invention, in a compressor for a gas turbine engine, there is provided an inner ring, an outer casing comprising upstream and downstream rings which are connected together, said upstream and downstream rings being provided respectively with facing upstream and downstream collars, a stage of variably settable stator blades arranged between said inner ring and said outer casing, each of said blades including a journal at its radially outer end, said journal having a peripheral groove extending at least partly therearound, and respective journal boxes for said journals of said blades mounted in said outer casing between said upstream and downstream rings thereof, each of said journal boxes having a radial bore which rotatably receives the respective journal, and a pair of parallel pins arranged longitudinally through said journal box and cooperating with said peripheral groove of said journal to hold said blade radially in said journal box.

In a preferred embodiment said peripheral groove in said journal of each of said blades comprises two symmetrically arranged arcuate portions separated from each other at opposite ends by two teeth which are engageable with said pins to limit the possible rotation of the blade.

Other characteristics of the invention will become apparent from the following description of the preferred embodiments with reference to the drawings.

DESCRIPTION OF THE PREFERRED EMBODIMENTS

Figure 1:
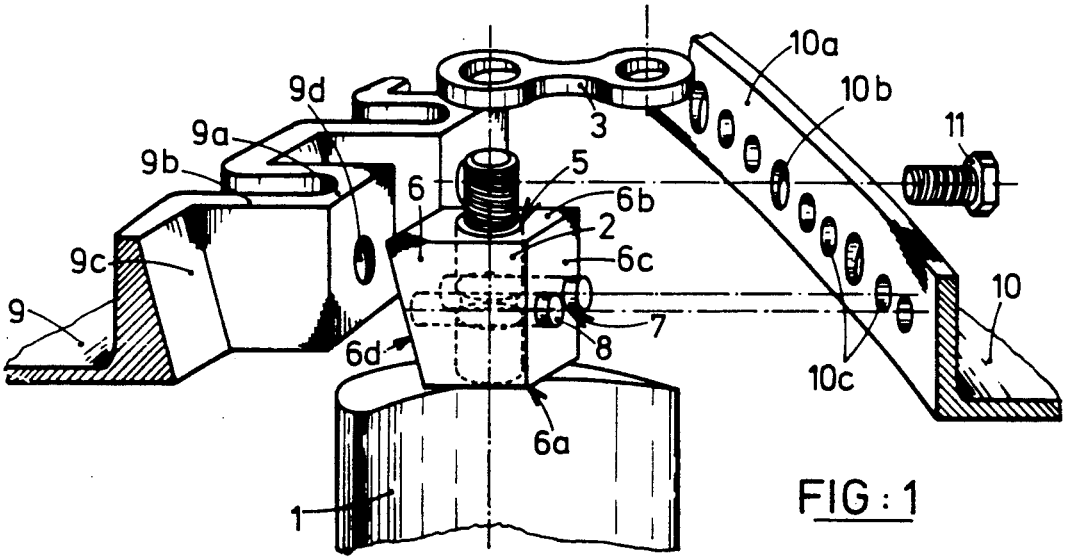
FIG. 1 is an exploded view of one embodiment of a compressor stator stage in accordance with the invention, showing the journal box mounted on a blade but not yet installed in the outer casing.
Figure 2:
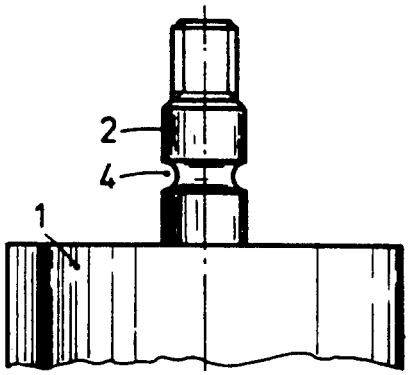
FIG. 2 is a partial view of a blade of the embodiment illustrated in FIG. 1.

FIG. 1 shows part of a stator stage with variably settable blades 1 having a journal 2 at the head end surmounted by a threaded part for the connection of the blade to a control link 3. About half way up its height the journal 2 has a circumferential annular groove 4 with a semi-circular profile.

The journal 2 is rotatably mounted in a radial bore 5 of a journal box 6 in the shape of a parallelepiped with a trapezoidal longitudinal section of which the smaller parallel side 6*a* faces radially inwards towards the axis of the engine and thus faces the tip of the aerofoil portion of the blade 1. The larger parallel side 6*b* of the box 6 thus faces outwards. The bore 5 is drilled right through the journal box 6 perpendicularly to the faces 6*a* and 6*b*.

The journal box 6 also has two holes 7 drilled longitudinally between its downstream face 6*c*, which is at right angles to the inner and outer faces 6*a*, 6*b*, and its slanting upstream face 6*d*, the holes 7 being parallel and symmetrical relative to a plane containing the axis of the bore 5. The two holes 7 are spaced at a distance equal to the diameter of the bore 5, which they partly intersect about half way up the box 6.

When the journal box 6 is mounted on the blade journal 2, two pins 8 are inserted into the holes 7 and engage with the groove 4 of the journal so as to connect the journal box and the journal together in the axial direction of the blade (i.e. the radial direction of the engine). The pins 8 are longer than the holes 7 so that, when they have been placed in position, they protrude from the downstream face 6*c* of the journal box.

The casing of the stator is divided into upstream and downstream rings 9 and 10 respectively having upstream and downstream collars 9*a* and 10*a* which face each other and through which the rings 9 and 10 are connected together by bolts 11 passing through holes 10*b* in the collar 10*a* into screw-threaded holes 9*d* in the collar 9*a*.

The upstream ring 9 also has, adjacent the collar 9*a* at its downstream edge, a circumferential array of bosses 9*b* defining housings 9*c* for the journal boxes 6 of the blades 1. Each housing 9*c* is formed by a recess in the respective boss 9*b* having a shape and size complementary to that of a journal box 6, the recess being open at its downstream end flush with the face of the upstream collar 9*a*. Thus, when the journal boxes 6 on the blades 1 are fitted into the housing recesses 9*c* and the downstream ring 10 is bolted to the upstream ring 9, the downstream collar 10*a* will fit against the downstream face 6*c* of each box 6 to complete the housings.

As shown in FIG. 1, the face of the downstream collar 10*a* is provided with pairs of blind holes 10*c* arranged to receive the ends of the pins 8 protruding from the face 6*c* of each journal box 6, thus securing the boxes 6 radially in their housings. In an alternative arrangement the blind holes 10*c* may be replaced by a single annular groove extending circumferentially around the face of the collar 10*a*.

The mounting of the blades 1 fitted with the journal boxes 6 in the casing is effected by positioning the boxes 6 in the housing recesses 9*c* of the upstream ring 9. Then, the downstream ring 10 is brought up and the collar 10*a* oriented in such a manner that the ends of the pins 8 protruding from the faces 6*c* of the boxes 6 enter the blind holes 10*c* of the collar 10*a*. When the collars 9*a* and 10*a* have been bolted together, the only parts protruding from the casing are the threaded outer ends of the blades. It is then possible to connect, in a known manner, the links 3 and the control ring 12 for adjusting the setting of the blades.

Figure 4:
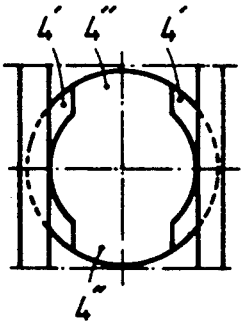
FIGS. 4 and 4*a* are sections through the journal of a blade of another embodiment of a compressor stator in accordance with the invention, illustrating the construction and operation of the peripheral groove of the journal to limit the angular movement of the blade in its journal box.
Figure 4A:
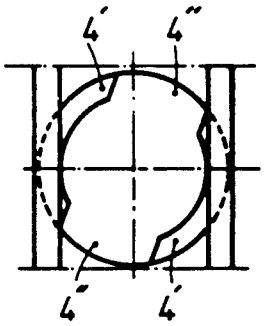
Figure 3:
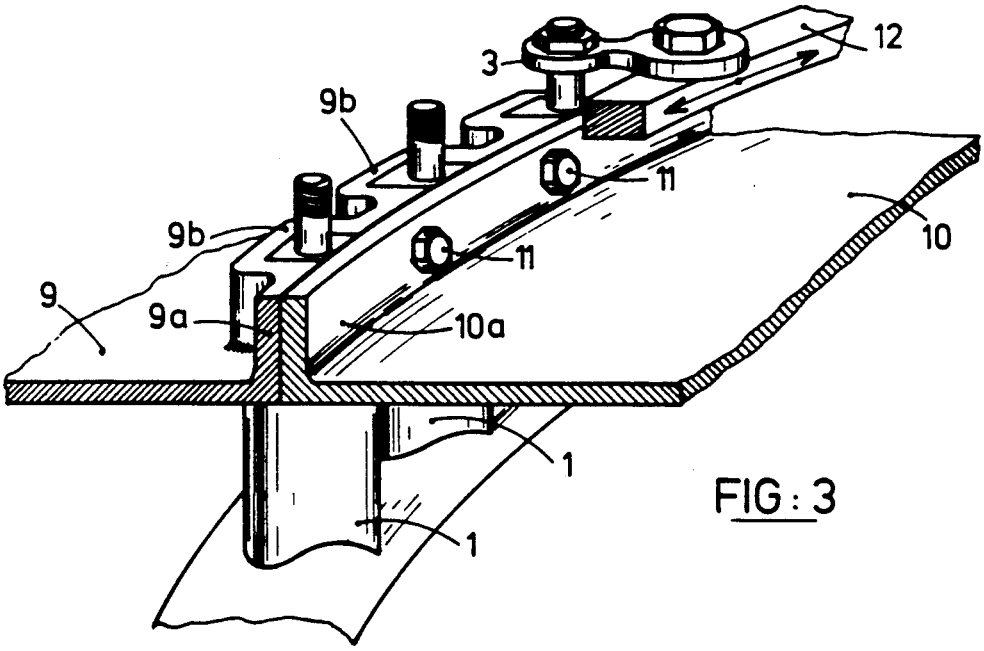
FIG. 3 is a perspective partial view of the stator of the embodiment of FIG. 1 in its assembled state, showing part of the control ring for adjusting the setting of the blades.

In the embodiment illustrated in FIGS. 4 and 4*a*, the circumferentially extending peripheral groove 4 of the journal in the first embodiment has been replaced by two symmetrically arranged arcuate grooves 4' with parallel axes and separated at opposite ends by two teeth 4''. Assembly of the stator stage is carried out in a manner identical to that described for the previous embodiment, but in the present case, if a link 3 should break during operation, the angular movement of the corresponding blade would be restricted by the teeth 4'' which would act as stops against the pins 8 housed in the grooves 4'. Thus, the blade will not be able to feather or to place itself across the flow path.

An advantage of the assembly in accordance with the invention is that it permits easy positioning and the radial holding of blades of small size made by extrusion, without requiring shoulders of a diameter greater than the thickness of the blade vane for their radial positioning, as was previously the case. Thus, with this construction, it is possible to use blades without any extra thickness and thus to achieve savings in manufacturing costs.

Obviously, numerous modifications and variations of the present invention are possible in light of the above teachings. It is therefore to be understood that within the scope of the appended claims, the invention may be practiced otherwise than as specifically described herein.

I claim:

1. In a compressor for a gas turbine engine, an inner ring, an outer casing comprising upstream and downstream rings which are connected together by means of bolts, said upstream and downstream rings being provided respectively with facing upstream and downstream collars, a stage of variably settable stator blades arranged between said inner ring and said outer casing, each of said blades including a journal at its radially outer end, said journal having a peripheral groove extending at least partly therearound, respective journal boxes for said journals of said blades being mounted in said outer casing between said upstream and downstream rings thereof, each of said journal boxes having a radial bore which rotatably receives the respective journal, and a pair of parallel pins arranged longitudinally through each of said journal boxes and cooperating with said peripheral groove of said journal to hold said blade radially in each of said journal boxes, wherein each of said journal boxes is of parallelepipedic shape with a trapezoidal longitudinal section of which the smaller parallel side faces radially inwards, and said outer casing defines respective housings for receiving said journal boxes, each of said housings comprising a boss on said upstream ring of said outer casing adjacent said upstream collar thereof, and a recess in said boss of a shape complementary to said journal box, said recess being open at its downstream end flush with the face of said upstream collar so that the downstream face of said journal box butts against said downstream collar of said downstream ring.

2. A compressor according to claim 1, wherein each of said journal boxes is provided with two parallel longitudinal holes which receive said parallel pins, said holes intersecting said radial bore and having axes which are symmetrical relative to a plane containing the axis of the radial bore and are spaced from each other by a distance equal to the diameter of said radial bore.

3. A compressor according to claim 1, wherein the length of said parallel pins is such that they protrude from the downstream face of said journal box, and said downstream collar of said downstream ring is provided with blind holes which receive the downstream ends of said pins to hold said journal box radially in its housing.

4. A compressor according to claim 1, wherein said peripheral groove in said journal of each of said blades comprises two symmetrically arranged arcuate portions separated from each other at opposite ends by two teeth which are engageable with said pins to limit the possible rotation of the blade.

* * * * *